US010150207B2

(12) United States Patent
Roberts et al.

(10) Patent No.: US 10,150,207 B2
(45) Date of Patent: Dec. 11, 2018

(54) TOOL FOR ROTATING TWO COMPONENTS OF ASSEMBLY RELATIVE TO EACH OTHER

(71) Applicant: The Boeing Company, Chicago, IL (US)

(72) Inventors: Matthew K. Roberts, Shoreline, WA (US); Brent F. Craig, Seattle, WA (US); Wesley E. Holleman, Long Beach, CA (US)

(73) Assignee: The Boeing Company, Chicago, IL (US)

( * ) Notice: Subject to any disclaimer, the term of this patent is extended or adjusted under 35 U.S.C. 154(b) by 136 days.

(21) Appl. No.: 15/347,609

(22) Filed: Nov. 9, 2016

(65) Prior Publication Data

US 2018/0126524 A1 May 10, 2018

(51) Int. Cl.

| | |
|---|---|
| ***B25B 23/14*** | (2006.01) |
| ***B25B 13/48*** | (2006.01) |
| ***B25B 13/08*** | (2006.01) |
| ***B25B 23/00*** | (2006.01) |
| ***B25B 23/142*** | (2006.01) |

(52) U.S. Cl.

CPC ..... *B25B 23/141* (2013.01); *B25B 13/08* (2013.01); *B25B 13/488* (2013.01); *B25B 23/0085* (2013.01); *B25B 23/1427* (2013.01)

(58) Field of Classification Search

USPC ..... 81/467

See application file for complete search history.

(56) References Cited

U.S. PATENT DOCUMENTS

| | | | | |
|---|---|---|---|---|
| 1,261,006 A * | 4/1918 | Bartelt | B25B 23/0085 | 81/13 |
| 1,824,300 A * | 9/1931 | Rowland | B25B 13/48 | 81/56 |
| 3,979,977 A * | 9/1976 | Dorma | B25B 21/002 | 81/57.13 |
| 4,976,159 A * | 12/1990 | Snyder | B25B 17/00 | 73/862.21 |
| 5,501,107 A * | 3/1996 | Snyder | B25B 17/00 | 73/862.23 |
| 7,484,438 B2 * | 2/2009 | Murphy | B23Q 5/045 | 81/57.13 |

OTHER PUBLICATIONS

"Seekonk Torque Limiting Knobs", Seekonk Manufacturing Co., Inc., Retrieved from the Internet: http://www.seekonk.com/prod-24-1-106-35/seekonk-torque-limiting-knobs.htm, 2015, 1 pg.

* cited by examiner

*Primary Examiner* — Hadi Shakeri
(74) *Attorney, Agent, or Firm* — Kwan & Olynick LLP

(57) ABSTRACT

A tool for rotating a first component of an assembly relative to a second component of the assembly is disclosed. The tool comprises a ring support, a first wrench, coupled to the ring support, a worm ring, rotationally coupled to the ring support, a second wrench, coupled to the worm ring, and a worm screw, rotationally coupled to the ring support and in mesh with the worm ring.

20 Claims, 17 Drawing Sheets

TOOL FOR ROTATING TWO COMPONENTS OF ASSEMBLY RELATIVE TO EACH OTHER

TECHNICAL FIELD

The present disclosure relates to apparatuses and methods for tightening or loosening threaded couplings.

BACKGROUND

A torque must be applied to a threaded coupling to tighten or loosen such coupling. The torque is typically applied using at least one wrench, having a handle and a wrench head, connected to the handle and configured to engage a component of the threaded coupling. A force is applied to the handle of the wrench to generate torque at the threaded coupling. The applied force, which may have a substantial magnitude, is also transferred to the threaded coupling and its supporting components (e.g., bearings). In some cases, the radial component of this force may damage (statically overload) the components, supporting the threaded coupling. As such, application of large radial forces on the threaded coupling is not desirable.

SUMMARY

Accordingly, apparatuses and methods, intended to address at least the above-identified concerns, would find utility.

The following is a non-exhaustive list of examples, which may or may not be claimed, of the subject matter according to the invention.

One example of the subject matter according to the invention relates to a tool for rotating a first component of an assembly relative to a second component of the assembly. The tool comprises a ring support, a first wrench, coupled to the ring support, a worm ring, rotationally coupled to the ring support, a second wrench, coupled to the worm ring, and a worm screw, rotationally coupled to the ring support and in mesh with the worm ring.

A combination of worm ring and worm screw allows reducing axial forces applied to assembly, in comparison to conventional tools, when first component of assembly is rotated relative to second component using tool. This axial force reduction prevents damage to various components of assembly. It should be noted that axial forces are reduced while being able to apply sufficient torque onto assembly. A combination of worm ring and worm screw provide substantial gear reduction in a very compact form. Because of this gear reduction, the same torque level can be achieved by applying much smaller forces to worm screw than when forces are applied directly to wrenches, as in conventional tools.

Furthermore, the combination of worm ring and worm screw changes the direction of forces applied to tool and, though tool, to assembly in comparison to conventional tools. Specifically, in conventional tools, a force is applied within a plane perpendicular to an axis of rotation of first component of assembly to second component, which is the same as worm-ring rotation axis. To operate tool, a force is applied within a place parallel to the axis of rotation of first component of assembly to second component. A combination of worm ring and worm screw effectively turn the force-applying plane because worm ring and worm screw themselves rotate around axes that are turned 90° with respect to each other.

BRIEF DESCRIPTION OF THE DRAWINGS

Having thus described one or more examples of the invention in general terms, reference will now be made to the accompanying drawings, which are not necessarily drawn to scale, and wherein like reference characters designate the same or similar parts throughout the several views, and wherein:

FIG. 1 is a block diagram of a tool, according to one or more examples of the present disclosure;

FIG. 2A is a schematic, perspective view of the tool of FIG. 1, according to one or more examples of the present disclosure;

FIG. 2B is a schematic, perspective view of the tool of FIG. 2 with a housing of the tool removed, according to one or more examples of the present disclosure;

FIG. 2C is another schematic, perspective view of the tool of FIG. 2, according to one or more examples of the present disclosure;

FIG. 2D is yet another schematic, perspective view of the tool of FIG. 2, according to one or more examples of the present disclosure;

FIG. 2E is a schematic, perspective view of the tool of FIG. 2, according to one or more examples of the present disclosure, showing engagement of the tool with a threaded coupling;

FIG. 2F is a schematic, exploded view of the tool of FIG. 1, according to one or more examples of the present disclosure;

FIG. 3A is a schematic, exploded view of a sub-assembly of the tool of FIG. 1, according to one or more examples of the present disclosure, including a ring support and a worm ring;

FIG. 3B is a schematic, side view of a worm ring coupled to a second wrench of the tool of FIG. 1, according to one or more examples of the present disclosure;

FIG. 3C is a schematic, exploded view of a worm ring and a coupler of the tool of FIG. 1, according to one or more examples of the present disclosure;

FIG. 3D is a schematic, exploded view of a coupler and a bearing of the tool of FIG. 1, according to one or more examples of the present disclosure;

Figure 1:
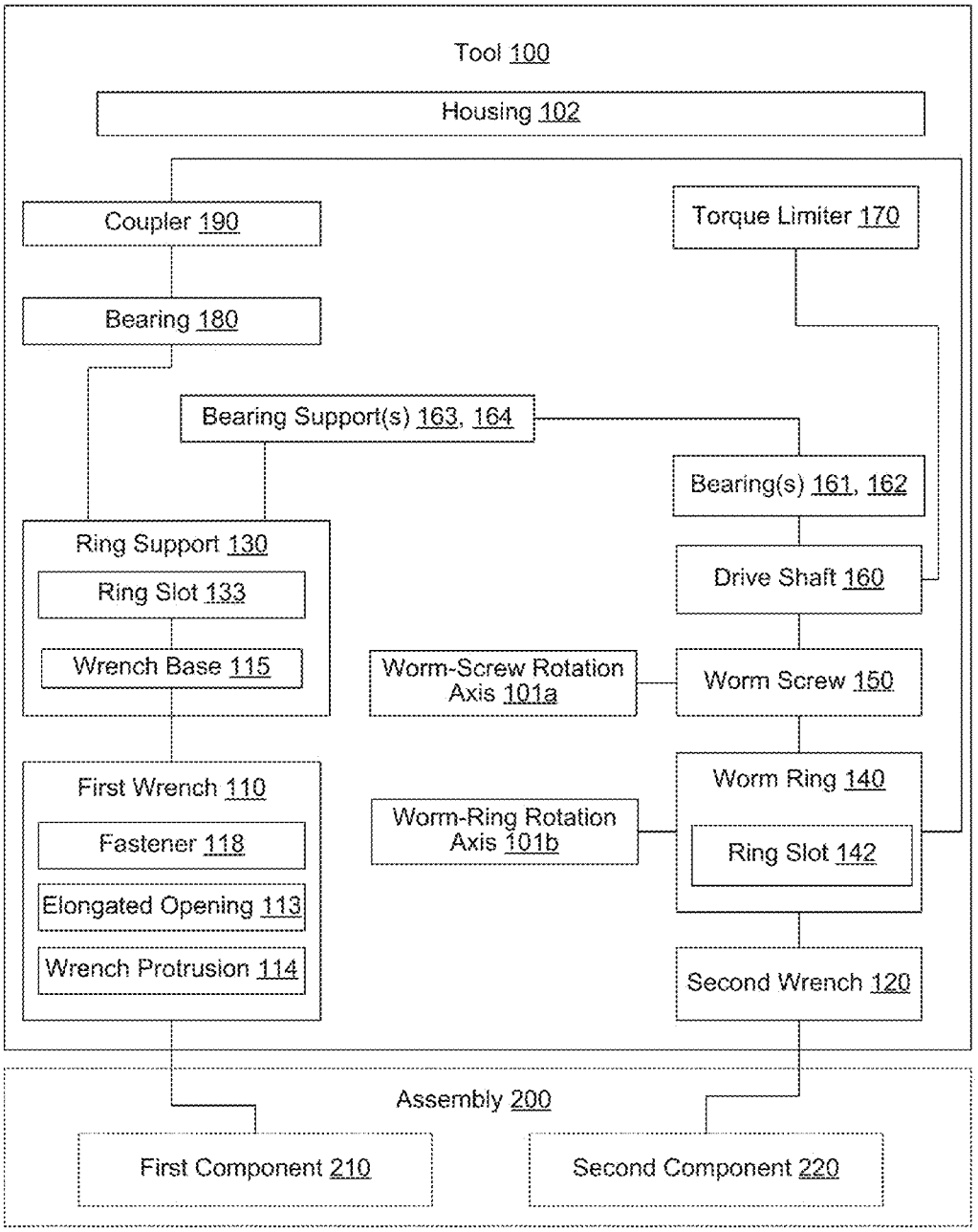
Figure 3A:
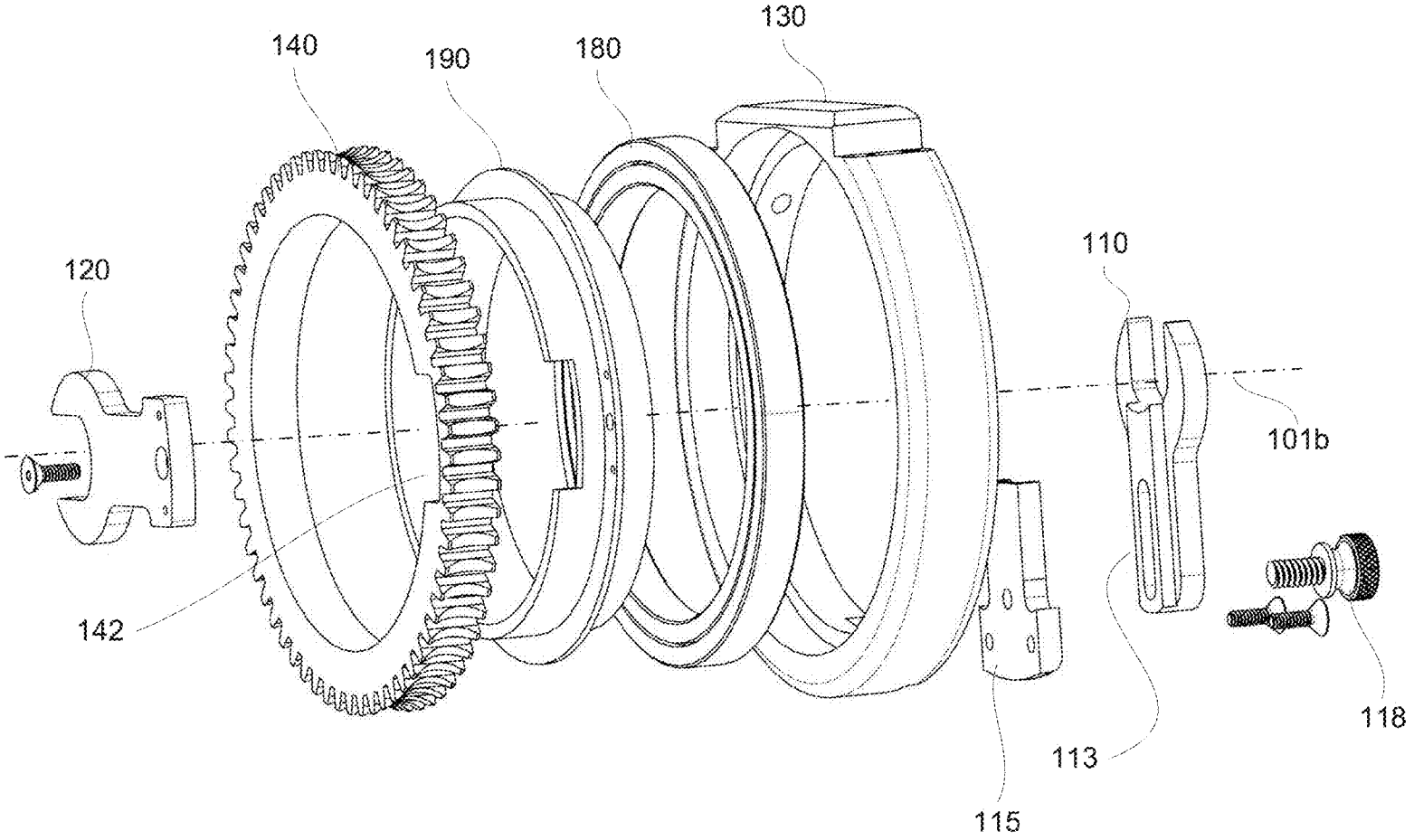
Figure 3C:
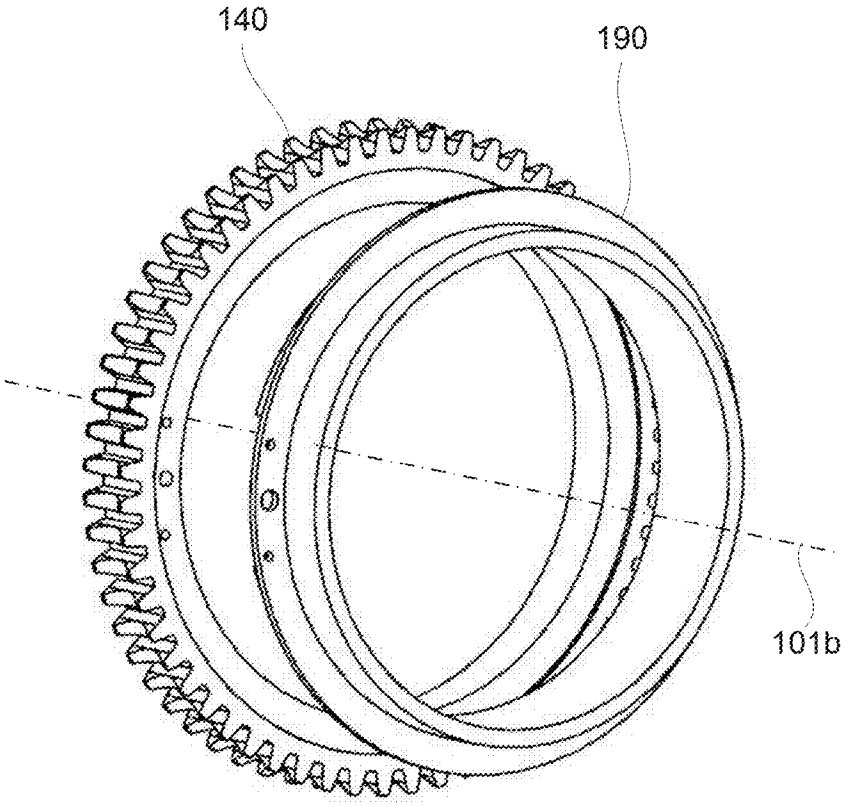
Figure 3B:
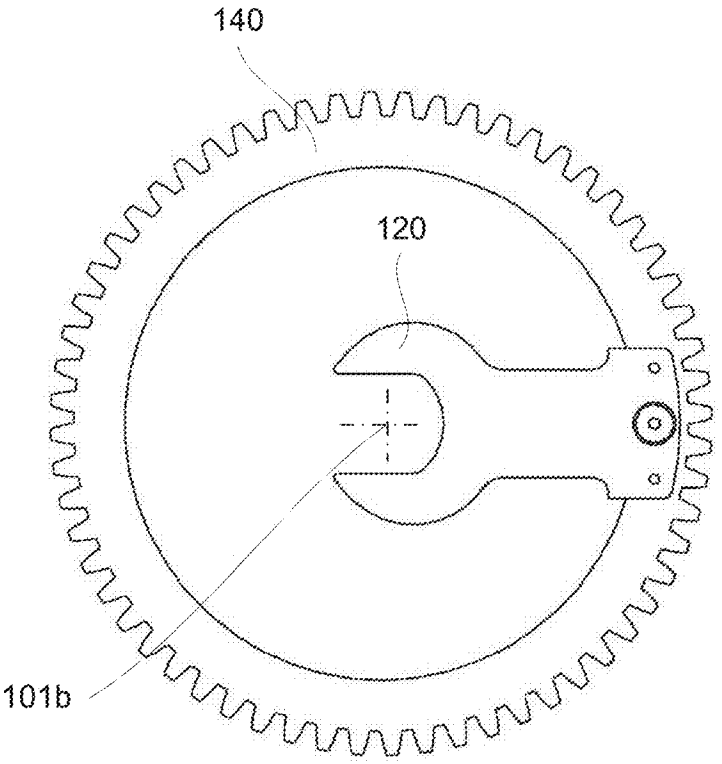
Figure 3E:
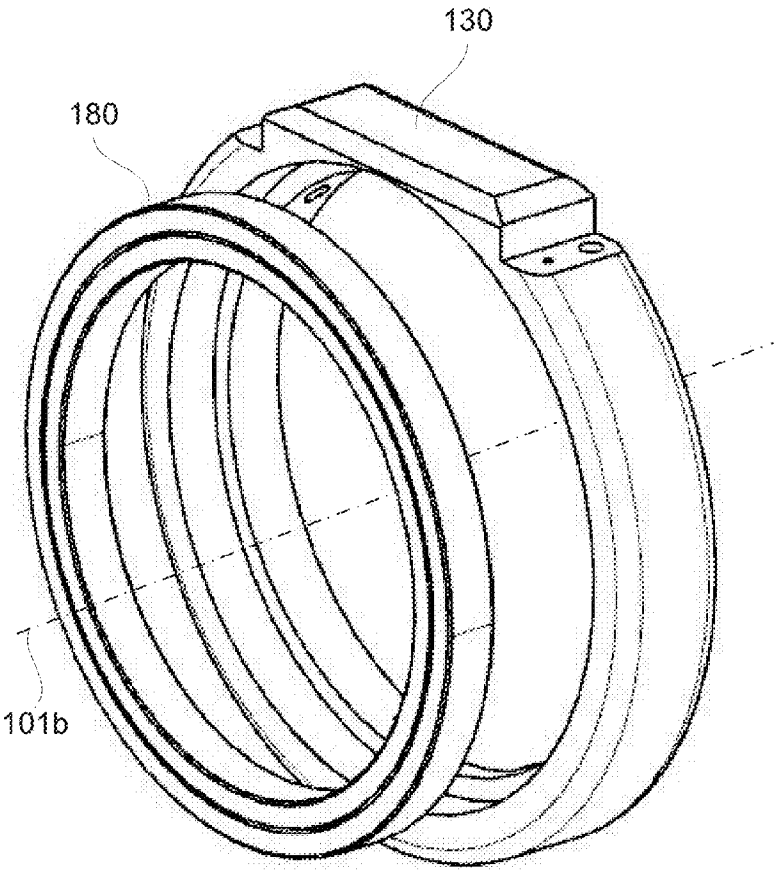
Figure 3D:
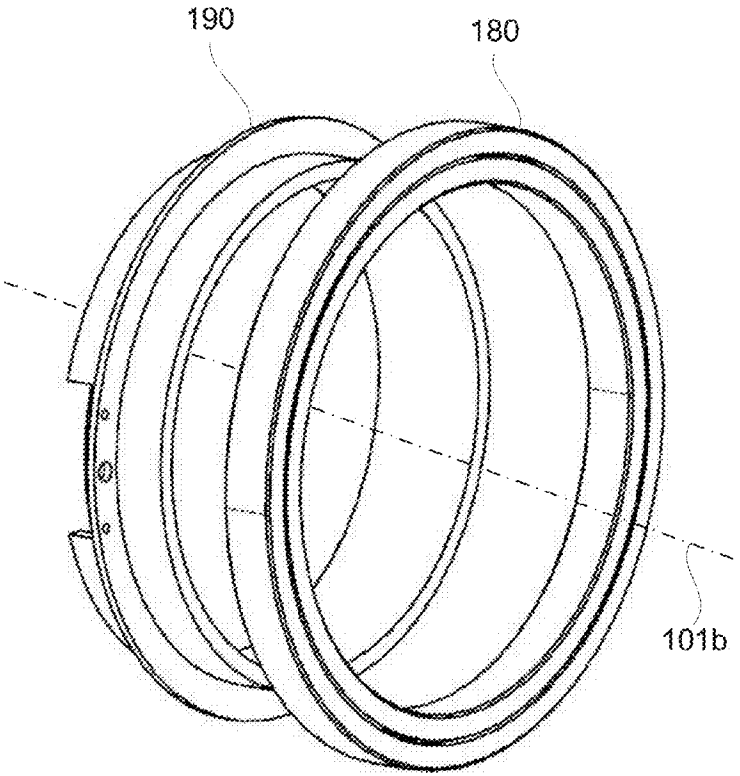
Figure 3G:
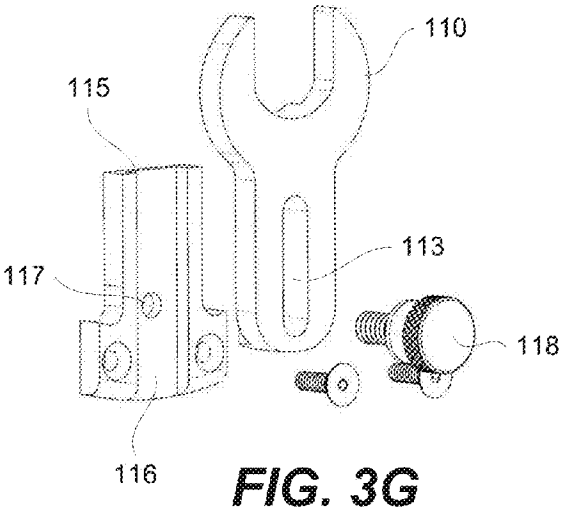
Figure 3H:
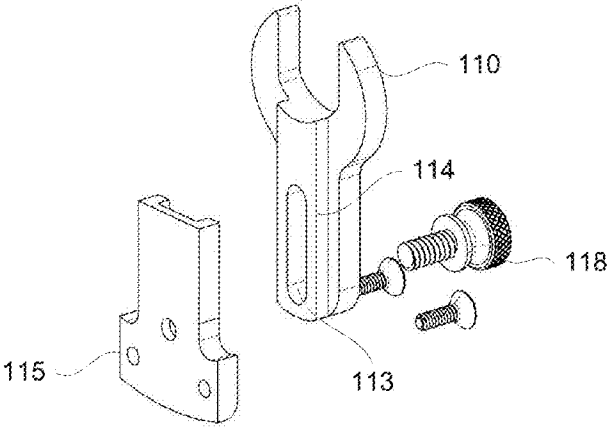
Figure 3F:
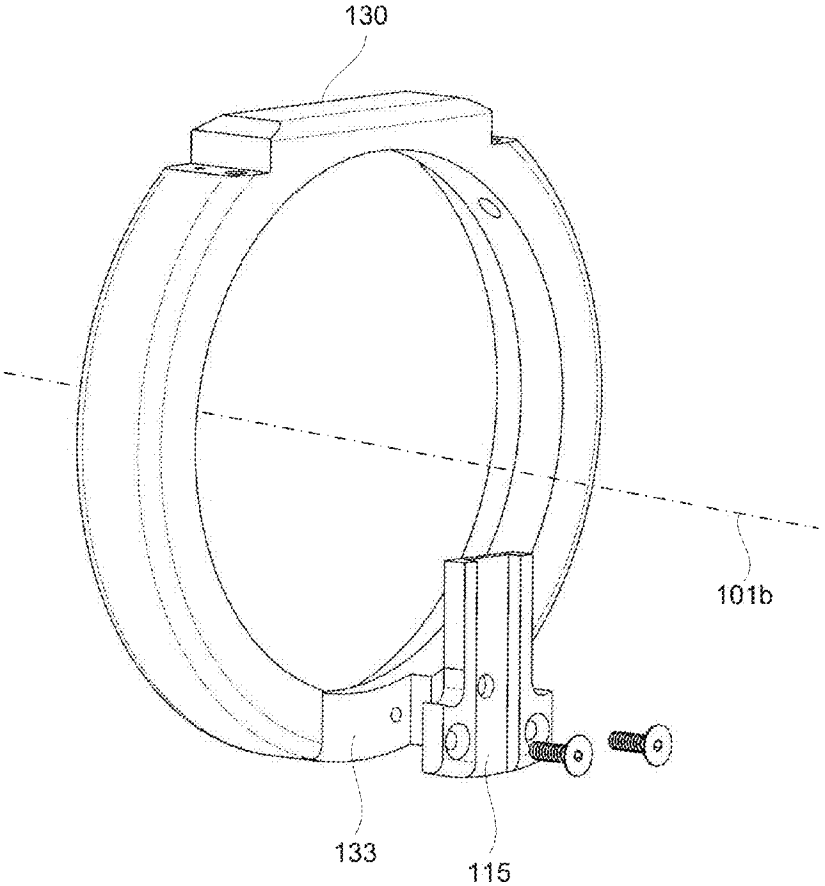
Figure 4A:
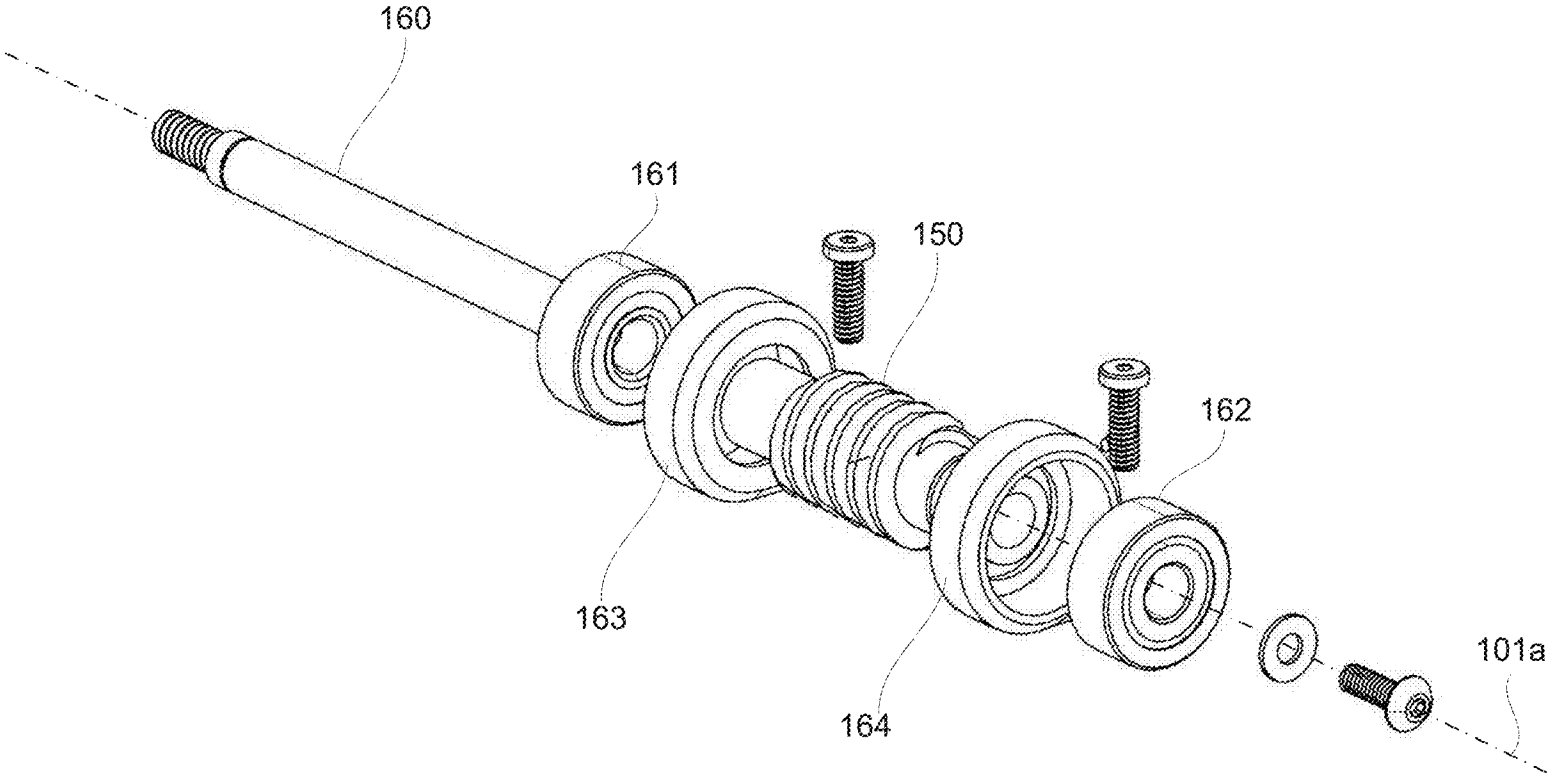
Figure 4C:
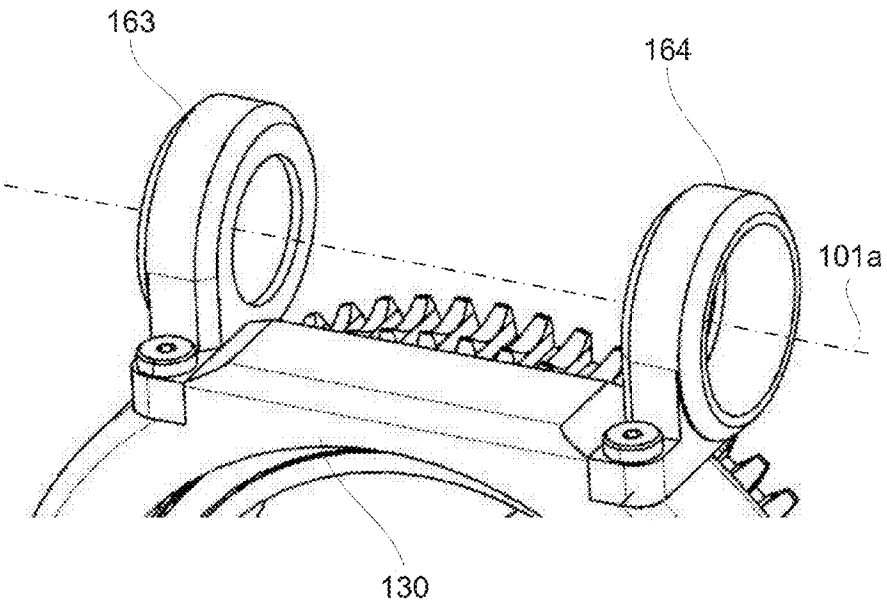
Figure 4B:
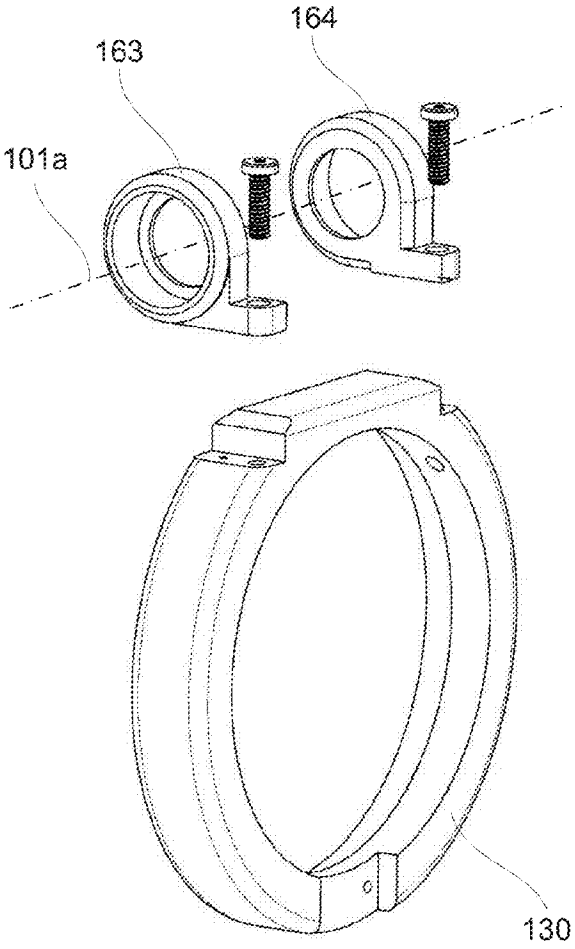
Figure 4E:
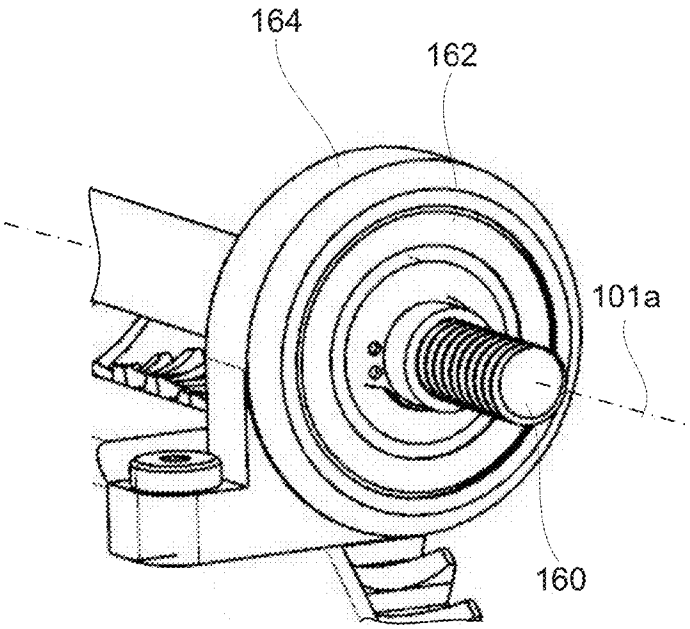
Figure 4D:
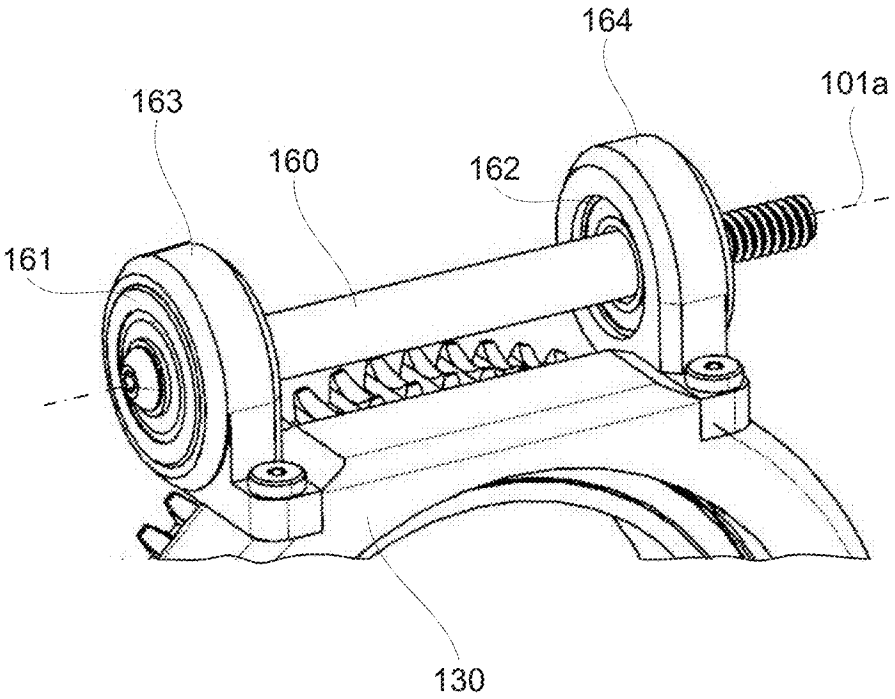
Figure 4F:
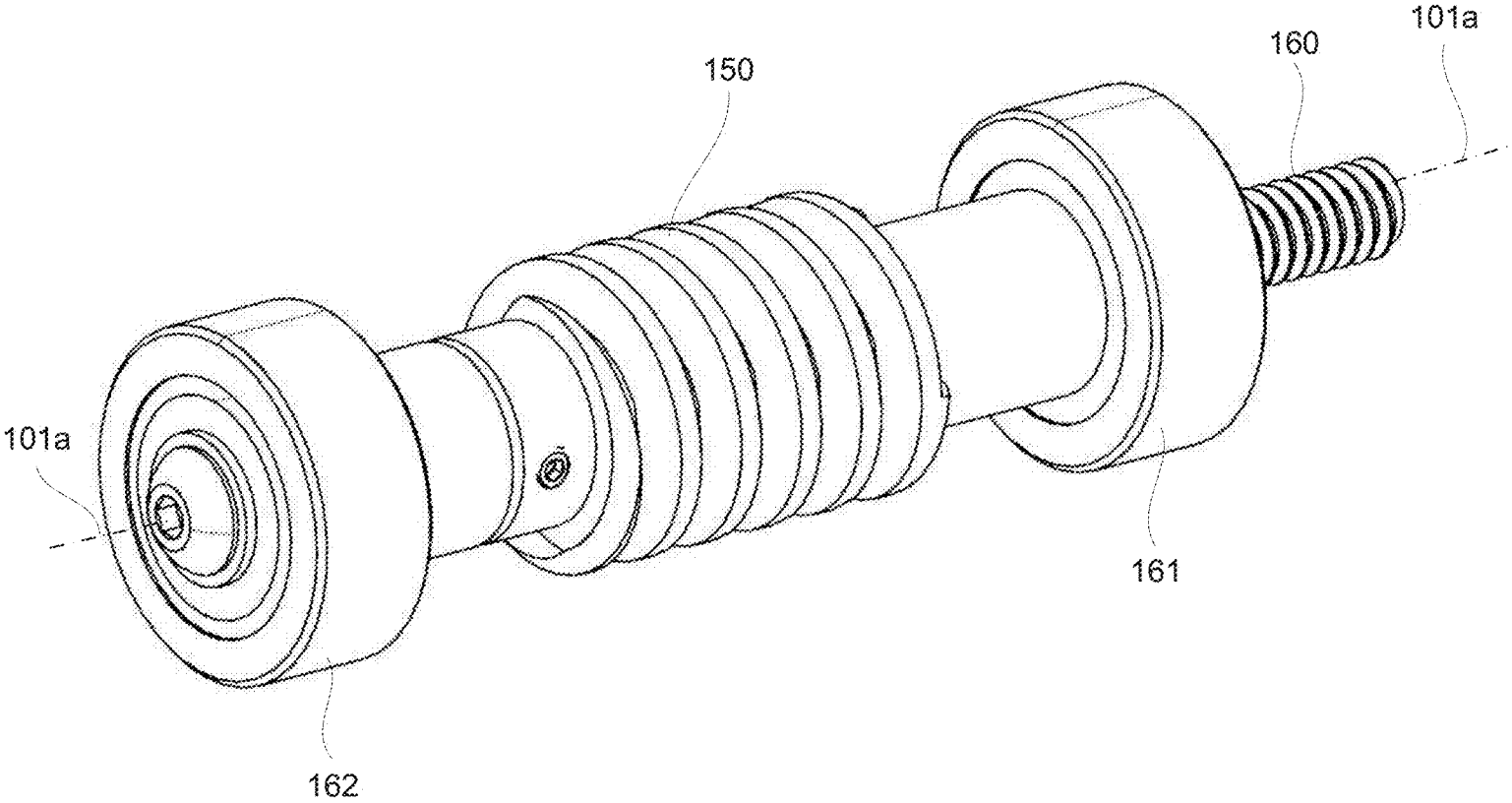
Figure 5:
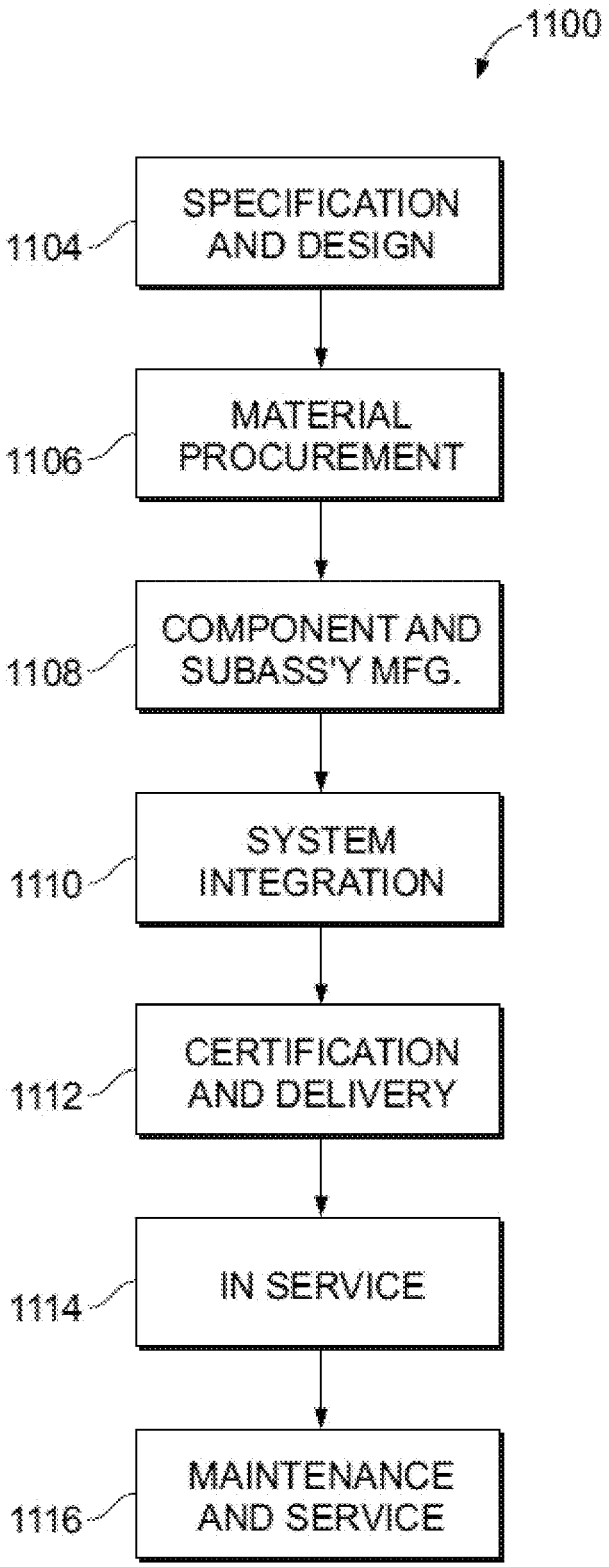
Figure 6:
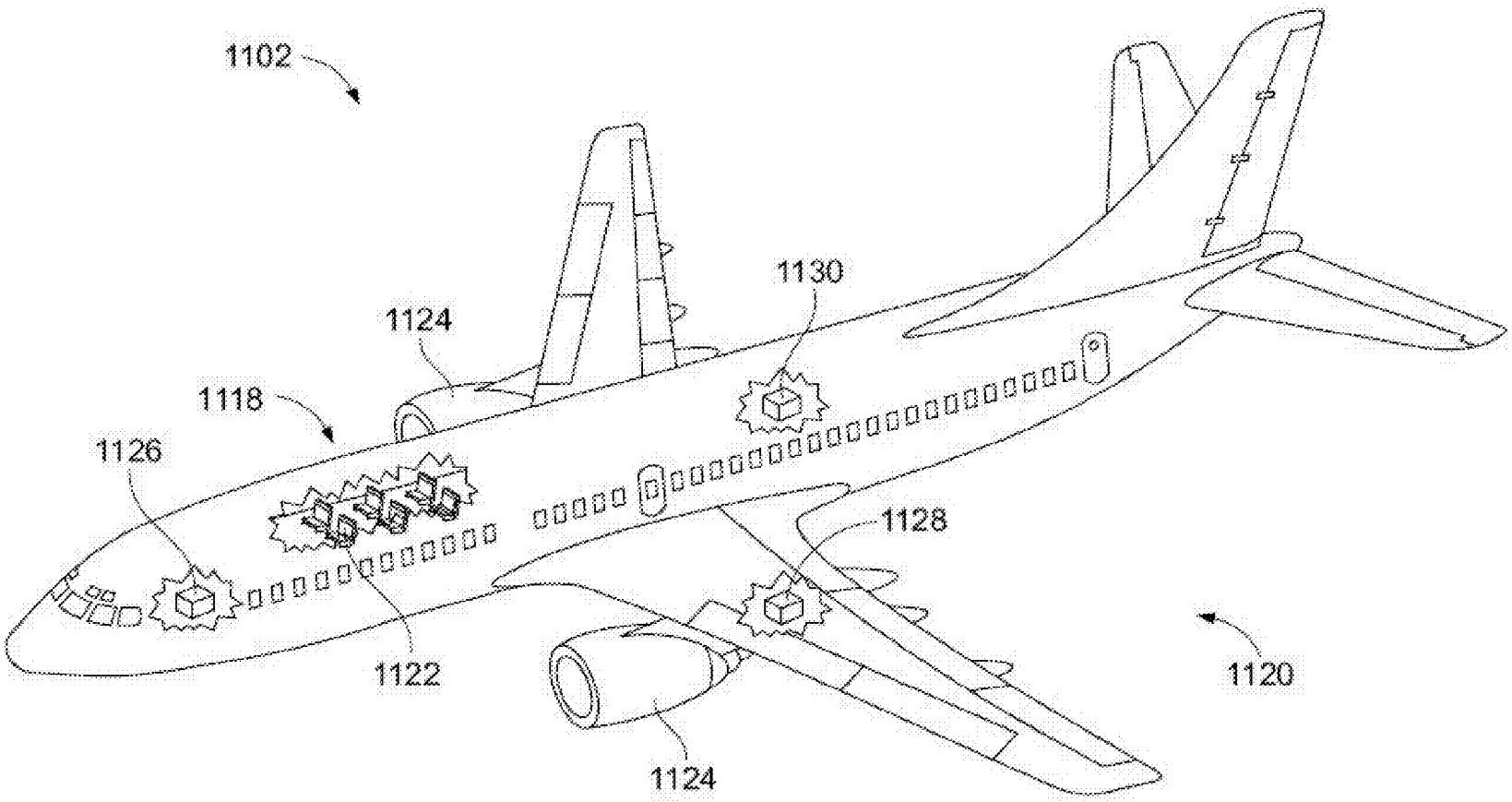

FIG. 3E is a schematic, exploded view of a bearing and a ring support of the tool of FIG. 1, according to one or more examples of the present disclosure;

FIG. 3F is a schematic, exploded view of a ring support and a wrench base of the tool of FIG. 1, according to one or more examples of the present disclosure;

FIGS. 3G and 3H are schematic, exploded views of a wrench base and a first wrench of the tool of FIG. 1, according to one or more examples of the present disclosure;

FIG. 4A is a schematic, exploded view of a portion the tool of FIG. 1, including a drive shaft and a worm screw, according to one or more examples of the present disclosure;

FIG. 4B is a schematic, exploded view of a ring support and two bearing supports of the tool of FIG. 1, according to one or more examples of the present disclosure;

FIG. 4C is a schematic, perspective view of two bearing supports, attached to a ring support of the tool of FIG. 1, according to one or more examples of the present disclosure;

FIG. 4D is a schematic, perspective view of a drive shaft, rotatably coupled to a ring support using two sets of bearings and bearing supports of the tool of FIG. 1, according to one or more examples of the present disclosure;

FIG. 4E is a detail schematic, perspective view of the second bearing and the second support bearing, rotatably coupling the drive shaft to ring support of FIG. 4D, according to one or more examples of the present disclosure;

FIG. 4F is a schematic, perspective view of a drive shaft, a worm screw, and two bearings of the tool of FIG. 1, according to one or more examples of the present disclosure;

FIG. 5 is a block diagram of aircraft production and service methodology; and FIG. 6 is a schematic illustration of an aircraft.

DETAILED DESCRIPTION

In FIG. 1, referred to above, solid lines, if any, connecting various elements and/or components may represent mechanical, electrical, fluid, optical, electromagnetic and other couplings and/or combinations thereof. As used herein, "coupled" means associated directly as well as indirectly. For example, a member A may be directly associated with a member B, or may be indirectly associated therewith, e.g., via another member C. It will be understood that not all relationships among the various disclosed elements are necessarily represented. Accordingly, couplings other than those depicted in the block diagrams may also exist. Dashed lines, if any, connecting blocks designating the various elements and/or components represent couplings similar in function and purpose to those represented by solid lines; however, couplings represented by the dashed lines may either be selectively provided or may relate to alternative examples of the present disclosure. Likewise, elements and/or components, if any, represented with dashed lines, indicate alternative examples of the present disclosure. One or more elements shown in solid and/or dashed lines may be omitted from a particular example without departing from the scope of the present disclosure. Environmental elements, if any, are represented with dotted lines. Virtual (imaginary) elements may also be shown for clarity. Those skilled in the art will appreciate that some of the features illustrated in FIG. 1 may be combined in various ways without the need to include other features described in FIG. 1, other drawing figures, and/or the accompanying disclosure, even though such combination or combinations are not explicitly illustrated herein. Similarly, additional features not limited to the examples presented, may be combined with some or all of the features shown and described herein.

In FIGS. 5 and 6, referred to above, the blocks may represent operations and/or portions thereof and lines connecting the various blocks do not imply any particular order or dependency of the operations or portions thereof. Blocks represented by dashed lines indicate alternative operations and/or portions thereof. Dashed lines, if any, connecting the various blocks represent alternative dependencies of the operations or portions thereof. It will be understood that not all dependencies among the various disclosed operations are necessarily represented. FIGS. 5 and 6 and the accompanying disclosure describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or simultaneously. Additionally, those skilled in the art will appreciate that not all operations described need be performed.

In the following description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Reference herein to "one example" means that one or more feature, structure, or characteristic described in connection with the example is included in at least one implementation. The phrase "one example" in various places in the specification may or may not be referring to the same example.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

Illustrative, non-exhaustive examples, which may or may not be claimed, of the subject matter according the present disclosure are provided below.

Referring generally to FIG. 1 and particularly to, e.g., FIGS. 2A-2F, tool 100 for rotating first component 210 of assembly 200 relative to second component 220 of assembly 200 is disclosed. Tool 100 comprises ring support 130, first wrench 110, coupled to ring support 130, worm ring 140, rotationally coupled to ring support 130, second wrench 120, coupled to worm ring 140, and worm screw 150, rotationally coupled to ring support 130 and in mesh with worm ring 140. The preceding subject matter of this paragraph characterizes example 1 of the present disclosure.

A combination of worm ring 140 and worm screw 150 allows reducing axial forces applied to assembly 200 by tool 100, in comparison to conventional tools, when first component 210 of assembly 200 is rotated relative to second component 220 using tool 100. Lower axial forces reduce the risk of damaging various components of assembly 200. It should be noted that even though the axial forces are reduced, tool 100 is still able to apply sufficient torque onto assembly 200. A combination of worm ring 140 and worm screw 150 provide substantial gear reduction in a very compact form. This gear reduction allows to achieve the same torque level with much smaller forces applied to tool 100 in comparison to conventional wrenches, in which forces are applied directly to wrenches.

Furthermore, the combination of worm ring 140 and worm screw 150 changes the direction of forces applied to tool 100 and to assembly 200 in comparison to conventional tools. Specifically, in conventional tools, forces are applied within a plane perpendicular to a rotation axis of components being rotated with these tools. In tool 100 described herein, forces are applied within a plane parallel to the axis of rotation of first component 210 to second component 220 of assembly 200. The combination of worm ring 140 and worm screw 150 effectively turns the plane in which forces are applied because the rotation axes of worm ring 140 and worm screw 150 are turned 90° with respect to each other. The rotation axes are referred to as worm-ring rotation axis 101*b* and worm-screw rotation axis 101*a*, respectively.

Figure 2A:
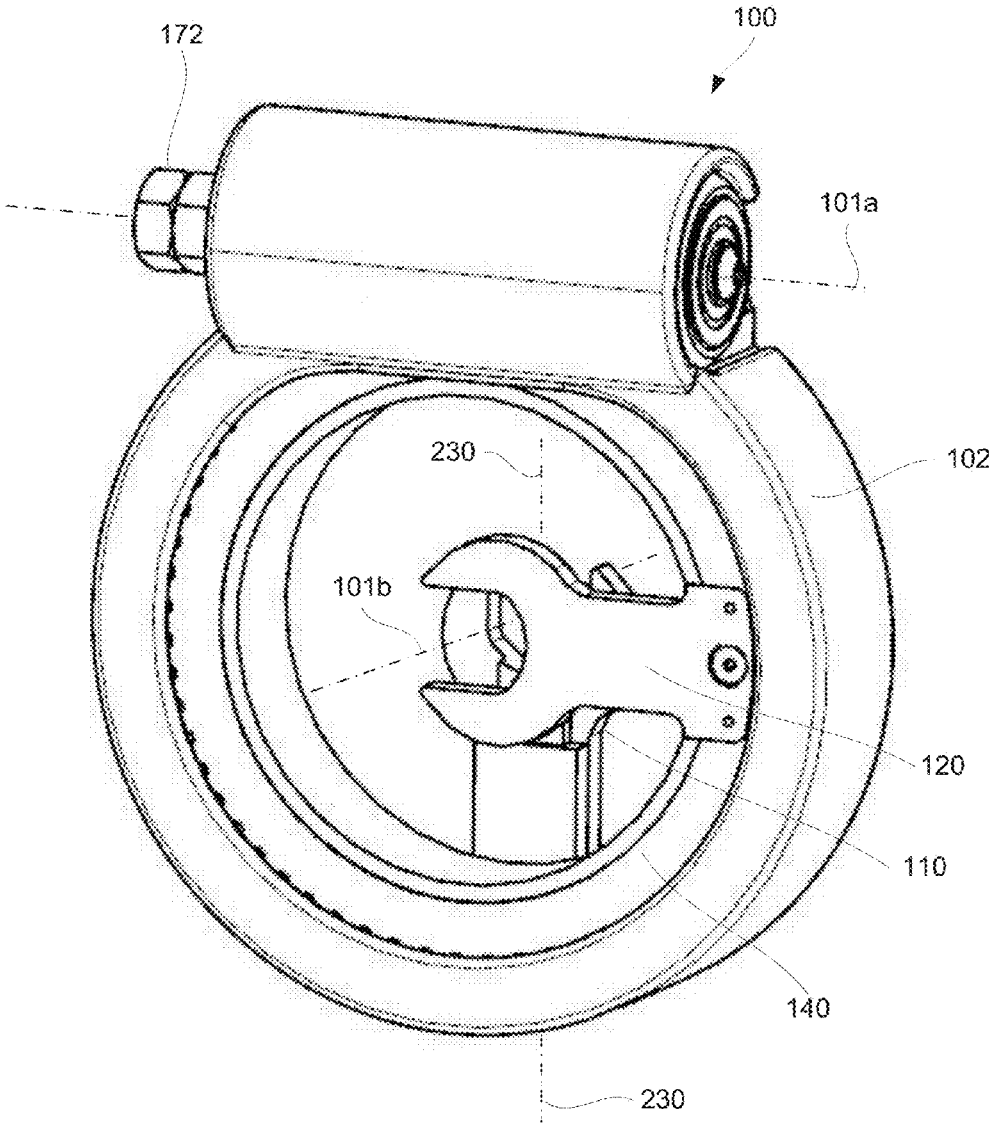
Figure 2B:
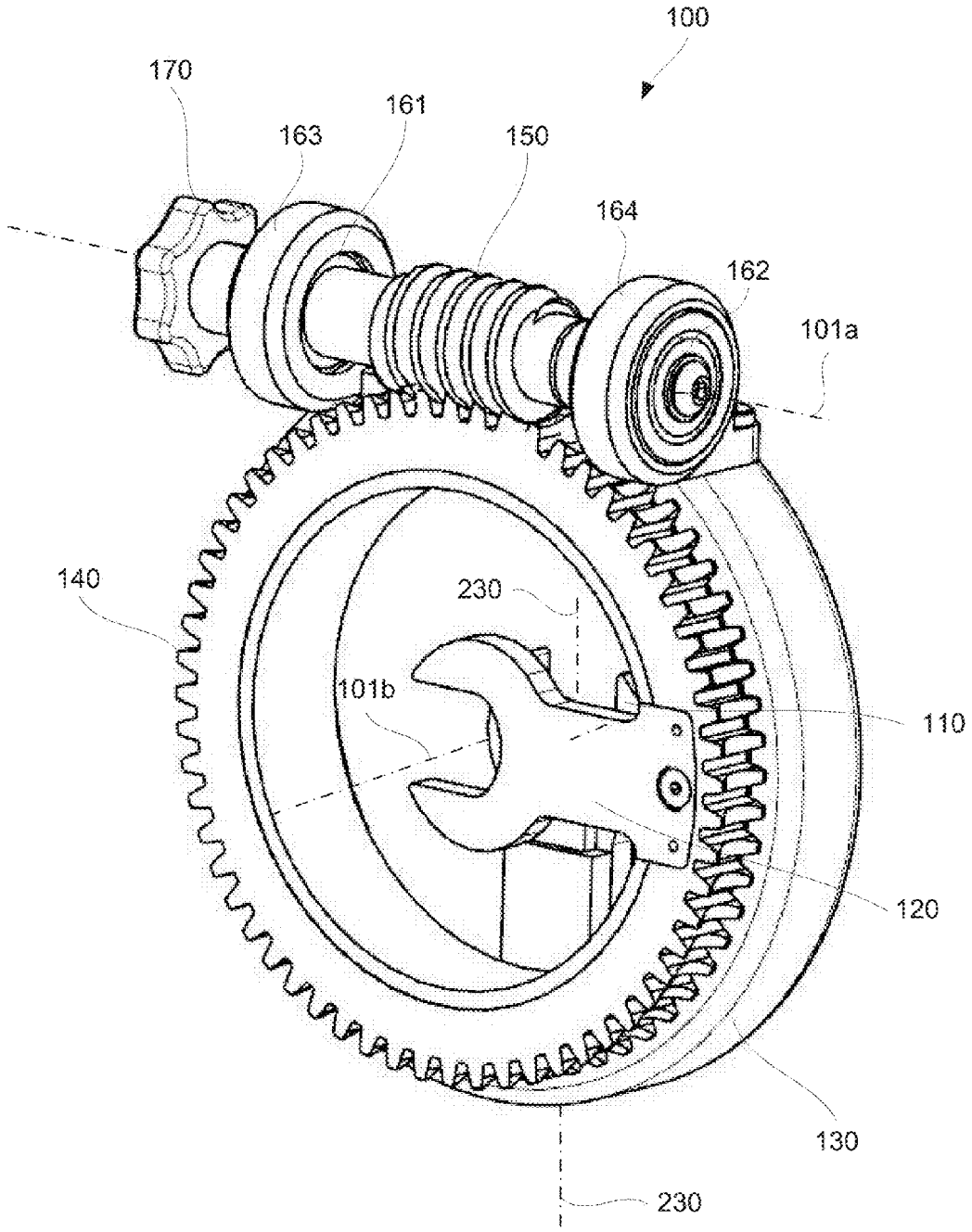
Figure 2C:
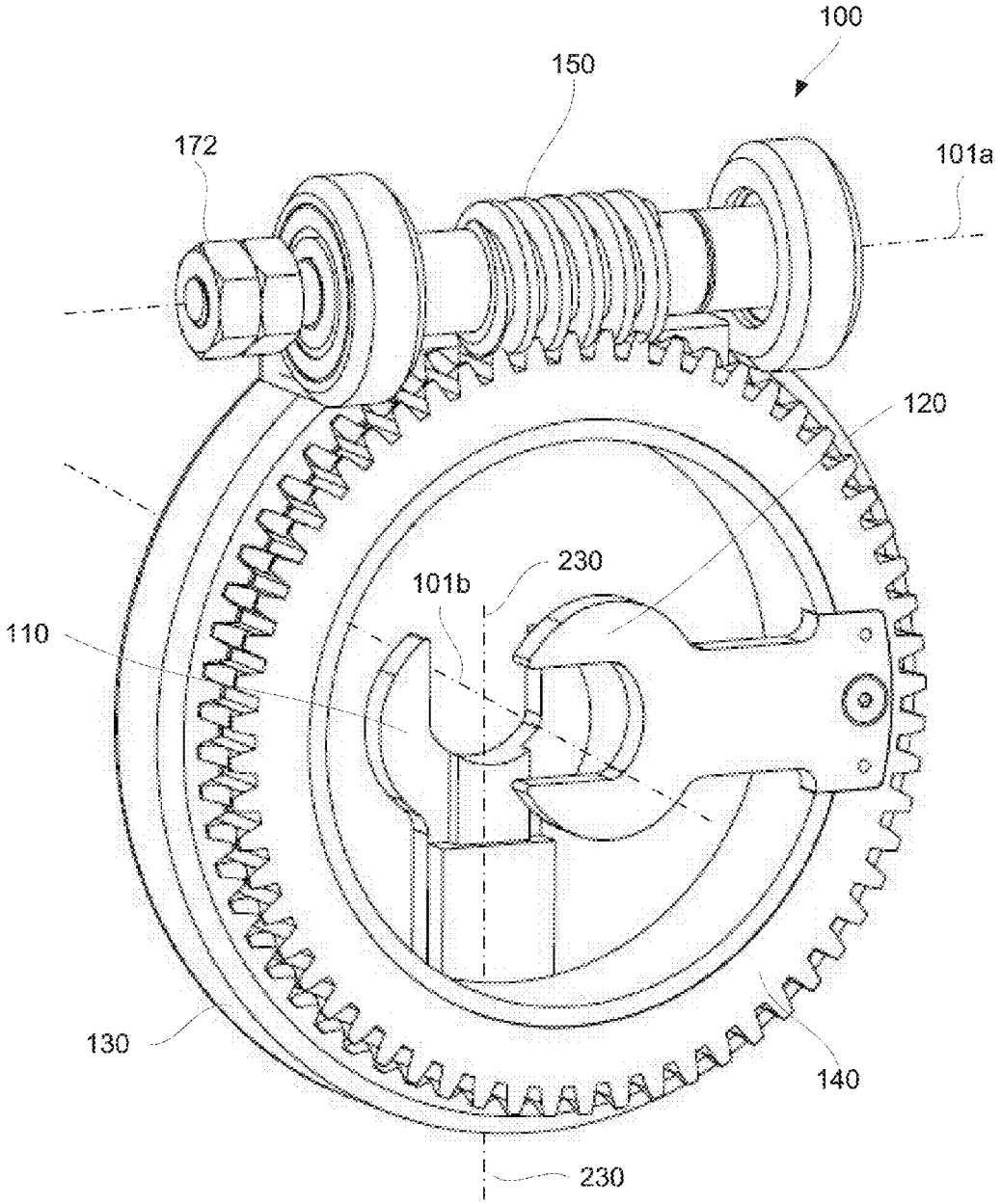
Figure 2D:
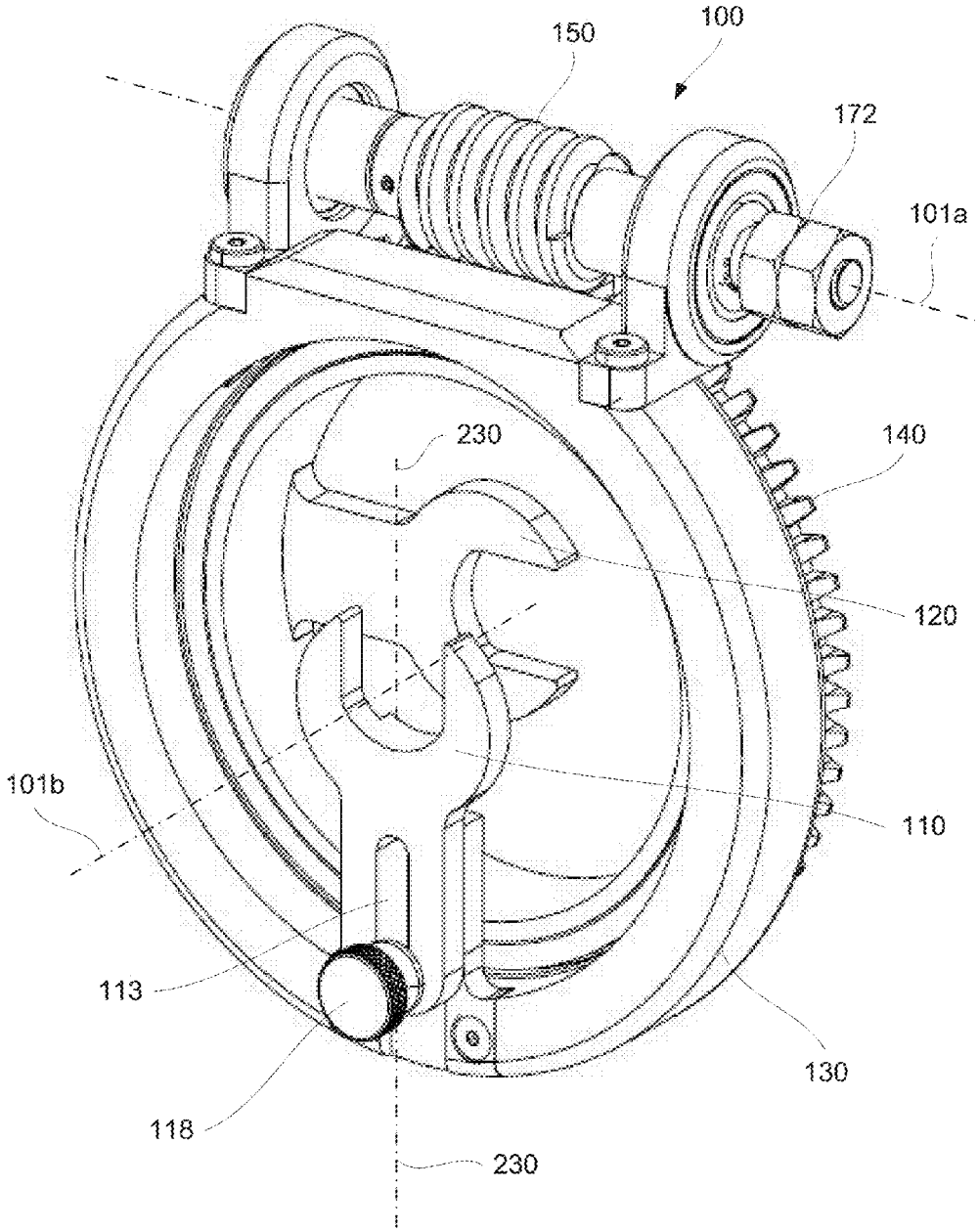
Figure 2E:
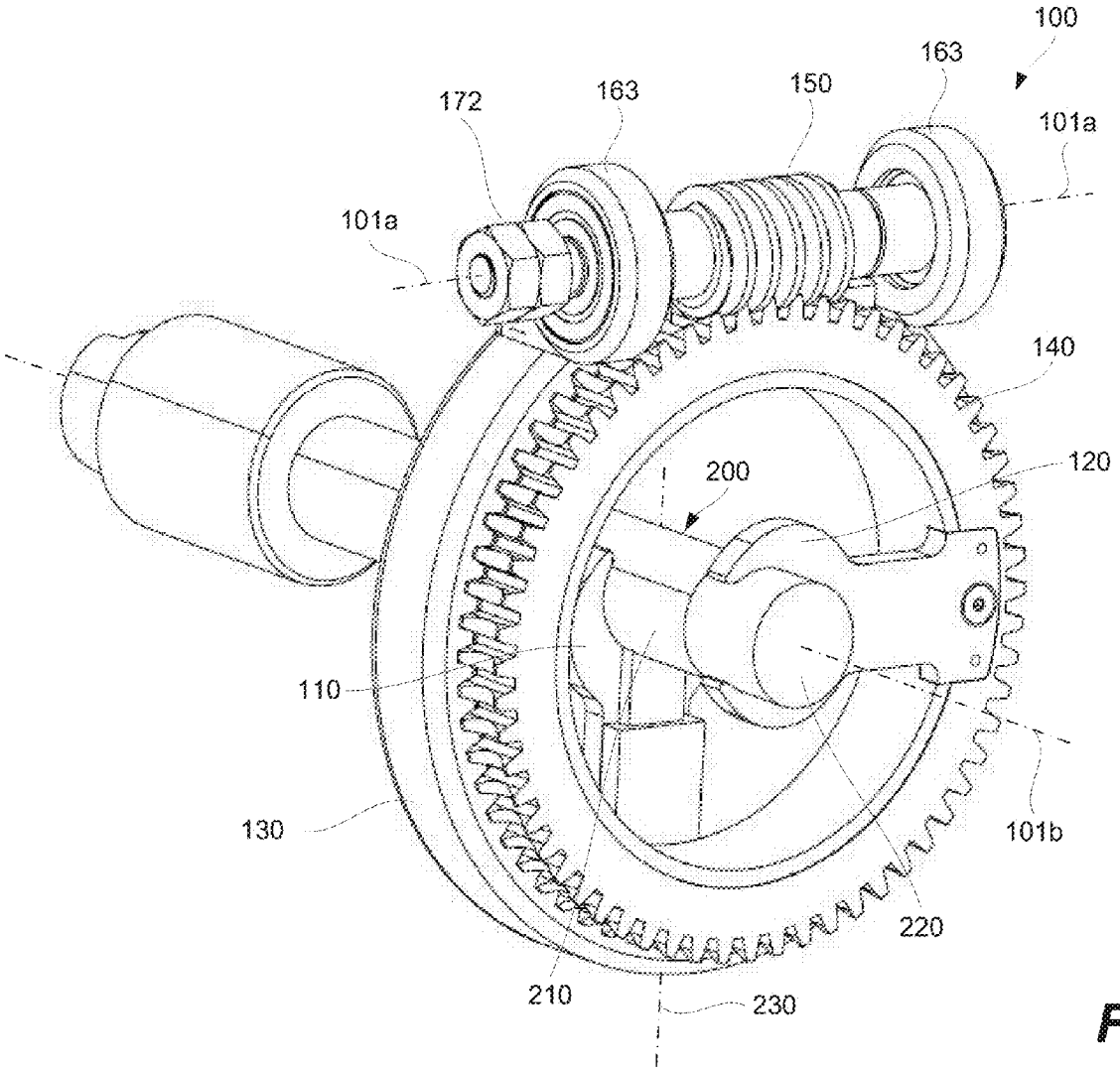

With particular reference to FIG. 2E, during operation of tool 100, first wrench 110 engages first component 210 of assembly 200, while second wrench 120 engages second component 220 of assembly 200. First wrench 110 is coupled to ring support 130, which supports first wrench 110. Second wrench 120 is coupled to worm ring 140, which supports second wrench 120. Worm ring 140 is also rotationally coupled to ring support 130 and in mesh with worm ring 140. Worm screw 150 extends along worm-screw rotation axis 101*a*.

During operation of tool 100, worm screw 150 is rotated around worm-screw rotation axis 101*a* using externally applied forces. This rotation of worm screw 150 causes rotation of worm ring 140 around worn-ring rotation axis 101*b* relative to ring support 130. The rotation of worn-ring rotation axis 101*b* causes rotation of second component 220 relative to first component 210 of assembly 200. Overall, applying forces to worm screw 150 creates a torque between first component 210 and second component 220 and causes first component 210 and second component 220 to rotate relative to each other.

Referring generally to FIG. 1 and particularly to, e.g., FIG. 2D, first wrench 110 is translatably coupled to ring support 130. The preceding subject matter of this paragraph characterizes example 2 of the present disclosure, wherein example 2 also includes the subject matter according to example 1, above.

The translatable coupling of first wrench 110 to ring support 130 can be used to engage first component 210 of assembly 200 with first wrench 110. Furthermore, this translatable coupling can be used to provide more space for assembly 200 when assembly 200 is being engaged or disengaged from tool 100. Specifically, the translatable coupling allows to position first wrench 110 further away worm-ring rotation axis 101*b* thereby providing more spaces within the interior boundary of ring support 130. To engage first component 210, first component 210 may be oriented relative to first wrench 110 along translation axis 230 and first wrench 110 may be translated toward first component 210. To disengage first component 210, first wrench 110 may be translated away from first component 210. Once disengaged and translated away from the first component 210, first wrench 110 provides more spaces for first component 210 and the rest of entire assembly 200 to be removed from tool 100.

Referring generally to FIG. 1 and particularly to, e.g., FIG. 2D, worm ring 140 has worm-ring rotation axis 101*b*. First wrench 110 has elongated opening 113 and translation axis 230, perpendicular to worm-ring rotation axis 101*b* and parallel to elongated opening 113. First wrench 110 is translatable relative to ring support 130 along translation axis 230, which intersects worm-ring rotation axis 101*b*. The preceding subject matter of this paragraph characterizes example 3 of the present disclosure, wherein example 3 also includes the subject matter according to example 2, above.

Elongated opening 113 allows first wrench 110 to be translated relative to ring support 130 without being completely disconnected and separated from ring support 130. Elongated opening 113 may have parallel sides extending along translation axis. Furthermore, elongated opening 113 may have circular ends. The shape and size of elongated opening 113 may depend on the size and shape of a component protruding through elongated opening 113, such as fastener 118. The translation distance of first wrench 110 may be defined by the size of elongated opening 113 along translation axis 230. The size and position of elongated opening 113 may be such that first wrench 110 can move away from and clear first component 210 when, for example, first wrench 110 disengages first component 210. Furthermore, the size and position of elongated opening 113 may be such that first wrench 110 can engage first component 210.

The translation direction of first wrench 110 is defined by translation axis 230. Translation axis 230 may be perpendicular to worn-ring rotation axis 101*b* and coincides with worn-ring rotation axis 101*b*. As such, when engaging first component 210, first wrench 110 translates toward worn-ring rotation axis 101*b*. This translation of first wrench 110 may be limited by first component 210 or by elongated opening 113. When disengaging first component 210, first wrench 110 translates away from worn-ring rotation axis 101*b*. This translation of first wrench 110 may be limited by elongated opening 113.

Referring generally to FIG. 1 and particularly to, e.g., FIGS. 2D, 3G, and 3H, tool 100 further comprises fastener 118, extending through elongated opening 113 of first wrench 110 and coupling first wrench 110 to ring support 130. The preceding subject matter of this paragraph characterizes example 4 of the present disclosure, wherein example 4 also includes the subject matter according to example 3, above.

Fastener 118 couples first wrench 110 to ring support 130 thereby supporting first wrench 110 to ring support 130. Fastener 118 may be threaded directly into ring support 130 or indirectly, for example, using an intermediate component, such as wrench base 115. Furthermore, a combination of elongated opening 113 and fastener 118 allows first wrench 110 to translate relative to ring support 130 without being fully disconnected from ring support 130. When fastener 118 is tightened, first wrench 110 is fixed in its current position and cannot be further translated relative to ring support 130. When fastener 118 is loosened, without being completely removed and still extending through elongated opening 113, first wrench 110 can be translated relative to ring support 130. In this latter state, first wrench 110 remains translatably attached to ring support 130 and cannot be completely separated from ring support 130.

Referring generally to FIG. 1 and particularly to, e.g., FIGS. 2D, 3G, and 3H, elongated opening 113 is circumferentially closed. The preceding subject matter of this paragraph characterizes example 5 of the present disclosure, wherein example 5 also includes the subject matter according to example 4, above.

When elongated opening 113 is circumferentially closed, elongated opening 113 may be operable as positive stops during translation of first wrench 110 relative to ring support 130. Furthermore, elongated opening 113 being circumferentially closed prevents first wrench 110 from being completely separated from ring support 130 when fastener 118 is still threaded. Fastener 118 protrudes through elongated opening 113 and free to move within the boundaries of elongated opening 113 between its closed ends. These closed ends prevent first wrench 110 from translating further away such that fastener 118 no longer protrudes through elongated opening 113.

When fastener 118 is positioned at one end of elongated opening 113, first wrench 110 may be disengaged from first component 210 and may allow for assembly 200 to move relative to tool 100. This end of elongated opening 113 is the closest to worm-ring rotation axis 101*b*. The ability of fastener 118 to reach the opposite end of elongated opening 113 may depend on the size of first component 210 as well as the size of first wrench 110 and ring support 130. As fastener 118 approaches this opposite end, first wrench 110 engages first component 210. In some examples, first component 210, rather than the end of elongated opening 113, operates as the positive stop for first wrench 110 when first wrench 110 engages first component 210. Alternatively, fastener 118 may be allowed to reach this opposite end of elongated opening when first wrench 110 engages first component 210.

Referring generally to FIG. 1 and particularly to, e.g., FIGS. 2D, 3G, and 3H, when first wrench 110 is not locked relative to ring support 130 by fastener 118, first wrench 110 is translatable a finite distance relative to ring support 130 along translation axis 230. The preceding subject matter of this paragraph characterizes example 6 of the present disclosure, wherein example 6 also includes the subject matter according to example 5, above.

The finite translation distance is sufficient for first wrench 110 to engage first component 210 of assembly 200 at one translation position and to disengage first component 210 at another translation position. The finite translation distance may be determined primarily by the size of elongated opening 113 along translation axis 230. Another factor may include the size of fastener 118 or, more specifically, the cross-sectional dimension along translation axis 230 of a portion of fastener 118 extending through elongated opening 113. When first wrench 110 engages first component 210, additional factors for the finite translation distance may be the type and size of first wrench 110 and the type and size of first component 210.

Referring generally to FIG. 1 and particularly to, e.g., FIGS. 2D, 3G, and 3H, fastener 118 is operable to lock first wrench 110 relative to ring support 130. The preceding subject matter of this paragraph characterizes example 7 of the present disclosure, wherein example 7 also includes the subject matter according to any one of examples 5 to 6, above.

Fastener 118 locks first wrench 110 in order to maintain the set position of first wrench 110 relative to ring support 130 during operation of tool 100. For example, fastener 118 may lock first wrench 110 to keep first wrench 110 engaged to first component 210 of assembly 200. Furthermore, fastener 118 may lock first wrench 110 to keep first wrench 110 away from assembly 200 when, for example, assembly 200 is being engaged to or disengaged from tool 100.

Referring generally to FIG. 1 and particularly to, e.g., FIGS. 2D, 3G, and 3H, first wrench 110 is lockable relative to ring support 130 in a fixed position. The preceding subject matter of this paragraph characterizes example 8 of the present disclosure, wherein example 8 also includes the subject matter according to example 7, above.

The fixed position, at which first wrench 110 can be locked, may be a position where first wrench 110 engages first component 210 of assembly 200 or a position at which first wrench 110 disengaged from first component 210. For example, first wrench 110 may be locked in a position such that first wrench 110 provides the most space for assembly 200 when assembly 200 is being engaged to or disengaged from tool 100. Once locked in the fixed position, first wrench 110 cannot be further translated relative to ring support 130 and maintains its position relative to ring support 130. First wrench 110 may be locked relative to ring support 130, for example, when fastener 118 is tightened.

Referring generally to FIG. 1 and particularly to, e.g., FIGS. 2C, 3G, and 3H, first wrench 110 is lockable relative to ring support 130 in any one of plurality of fixed positions. The preceding subject matter of this paragraph characterizes example 9 of the present disclosure, wherein example 9 also includes the subject matter according to example 7, above.

Multiple lockable positions of first wrench 110 may be used for different operations of tool 100 and/or to accommodate different types and sizes of first component 210 as well as different types and sizes of first wrench 110. Furthermore, one lockable position may be used when first wrench 110 engages first component 210. Another lockable position may be used when first wrench 110 disengages first component 210. In some examples, first wrench 110 is lockable in any position between two end positions along translation axis 230.

Referring generally to FIG. 1 and particularly to, e.g., FIGS. 2B-2E, worm screw 150 is rotatable about worm-screw rotational axis 101*a*, which is perpendicular to worm-ring rotational axis 101*b*. The preceding subject matter of this paragraph characterizes example 10 of the present disclosure, wherein example 10 also includes the subject matter according to any one of examples 3 to 9, above.

Since worm-screw rotational axis 101*a* is perpendicular to worm-ring rotational axis 101*b*, external forces applied to tool 100 in order to rotate worm screw 150 may be within a plane perpendicular to worm-screw rotational axis 101*a*. This plane is also parallel to worm-ring rotational axis 101*b*. This orientation of the external forces may be more favorable to avoid damage to assembly 200 during operation of tool 100 since tool 100 effectively transfers these forces to assembly 200 when no additional support is provided to tool 100.

Worm screw 150 may rotated around worm-screw rotational axis 101*a* by applying external forces to worm screw 150, for example, through drive shaft 160. Since tool 100 is supported at least in part by assembly 200, these applied external forces are also applied by tool 100 to assembly 200. In some examples, tool 100 is entirely supported by assembly 200. Certain directions of these external forces may be less damaging than others. For example, applying forces within the plane perpendicular to worm-screw rotational axis 101*a* may, on average, have a smaller radial component on assembly 200 than, for example, when similar forces are applied within a plane perpendicular to worm-ring rotational axis 101*b*.

Referring generally to FIG. 1 and particularly to, e.g., FIG. 3F, tool 100 further comprises wrench base 115. Ring support 130 comprises ring slot 133. At least portion of wrench base 115 is received within ring slot 133 of ring support 130. Wrench base 115 is fixed to ring support 130. The preceding subject matter of this paragraph characterizes example 11 of the present disclosure, wherein example 11 also includes the subject matter according to any one of examples 2 to 10, above.

Using wrench base 115 as an intermediate component for attaching first wrench 110 to ring support 130 allows using different types of first wrench 110 with same ring support 130. This feature may be referred to as a wrench interchangeability feature. Furthermore, wrench base 115, being a separable component of ring support 130, can be manufactured independently from ring support 130, which simplifies the overall manufacturing process of tool 100. This feature may be referred to as a manufacturability feature.

Ring slot 133 of ring support 130 receives wrench base 115 and supports wrench base 115 at least in circumferential direction when the loads are transferred between ring support 130 and first wrench 110. The width of ring slot 133 may be substantially the same as the width of the portion of wrench base 115 inserted into ring slot 133. This width correspondence may be used for tight fit and support of wrench base 115. Wrench base 115 may be fixed or, more specifically, removably fixed to ring support 130 using one or more fasteners, such as screws. These fasteners may extend in the direction parallel to worm-ring rotational axis 101*b*.

Referring generally to FIG. 1 and particularly to, e.g., FIGS. 3G and 3H, wrench base 115 comprises base slot 116. A portion of first wrench 110 is translatably received within base slot 116 of wrench base 115. The preceding subject matter of this paragraph characterizes example 12 of the present disclosure, wherein example 12 also includes the subject matter according to example 11, above.

When first wrench 110 is translatably received within base slot 116 of wrench base 115, the walls of base slot 116 support first wrench 110 in at least the circumferential direction. This support allows load transfer between wrench base 115 and first wrench 110 while maintaining orientation of first wrench 110 relative to wrench base 115 and, more generally, relative to ring support 130. The width of base slot 116 may be substantially the same as the width of the portion of first wrench 110 inserted into base slot 116 to ensure tight fit. In some examples, first wrench 110 includes wrench protrusion 114 extending into base slot 116. The remaining portion of the handle of first wrench 110 may be positioned outside of base slot 116.

Referring generally to FIG. 1 and particularly to, e.g., FIGS. 2C and 2D, first wrench 110 is an open-end wrench. The preceding subject matter of this paragraph characterizes example 13 of the present disclosure, wherein example 13 also includes the subject matter according to any one of examples 1 to 12, above.

When first wrench 110 is an open-end wrench, first wrench 110 may engage first component 210 of assembly 200 by being translated along translational axis 230. Specifically, an open end of first wrench 110 may be facing first component 210. First component 210 may be a nut (e.g., a hexagonal nut) or a shaft with two parallel engagement surfaces. Two inner surfaces of first wrench 110 may contact these engagement surfaces of first component 210 and allow to transfer torque between first wrench 110 and first component 210 during operation of tool 100.

Referring generally to FIG. 1 and particularly to, e.g., FIGS. 2F, 3A, 3D, and 3E, tool 100 further comprises bearing 180, rotationally coupling worm ring 140 to ring support 130. The preceding subject matter of this paragraph characterizes example 14 of the present disclosure, wherein example 14 also includes the subject matter according to any one of examples 1 to 13, above.

Bearing 180 reduces friction between worm ring 140 to ring support 130 when worm ring 140 rotates relative to ring support 130. Bearing 180 may be a ring bearing or any other suitable bearing. Rotational speeds of worm ring 140 relative to ring support 130 may be small during operation of tool 100, which allows using various bearing options. A ring bearing has a simple construction and may be used in tool 100. Bearing 180 may be pressed fit into ring support 130. In other words, outside surface of bearing 180 may be pressed against inner surface of ring support 130 thereby retaining bearing 180 in ring support 130.

Referring generally to FIG. 1 and particularly to, e.g., FIGS. 2F, 3A, 3C, and 3D, tool 100 further comprises coupler 190. Worm ring 140 is fixed to coupler 190 and bearing 180 rotationally couples coupler 190 to ring support 130. The preceding subject matter of this paragraph characterizes example 15 of the present disclosure, wherein example 15 also includes the subject matter according to example 14, above.

Addition of coupler 190 between worm ring 140 and bearing 180 may simplify the design of worm ring 140 and bearing 180 and, in some examples, may also simplify engagement between worm ring 140 and bearing 180. For example, coupler 190 may have cylindrical protrusions extending on each side along worm-ring rotation axis 101*b*. One of these cylindrical protrusions may be pressed fit into worm ring 140, while the other cylindrical protrusion may be inserted into and rotationally coupled to bearing 180. In other words, coupler 190 may be fixed to worm ring 140 and rotationally coupled to bearing 180. Coupler 190 may also include a circumferential ridge disposed between the two cylindrical protrusions and extending away from worm-ring rotation axis 101*b*. This circumferential ridge may be operable as a spacer between worm ring 140 and bearing 180. Specifically, the circumferential ridge may be used to prevent worm ring 140 and bearing 180 from directly contacting each other when worm ring 140 rotates relative to bearing 180 around worm-ring rotation axis 101*b* during operation of tool 100.

Referring generally to FIG. 1 and particularly to, e.g., FIGS. 2B and 2C, worm ring 140 and worm screw 150 have a gear ratio between about two and one hundred. The preceding subject matter of this paragraph characterizes example 16 of the present disclosure, wherein example 16 also includes the subject matter according to any one of examples 1 to 15, above.

The gear ratio of worm ring 140 and worm screw 150 being greater than one allows applying smaller forces to tool 100 or, more specifically, to worm screw 150 in comparison to conventional wrenches. These smaller forces still allow to achieve necessary torque levels between first wrench 110 and second wrench 120. For example, when the gear ratio between worm ring 140 and worm screw 150 is ten, a complete rotation of worm ring 140 requires ten rotations of worm screw 150. It should be noted that the complete rotation of worm ring 140 corresponds to a complete rotation of first wrench 110 relative to second wrench 120. As such, the value of output torque, which rotates first component 210 relative to second component 220, will be ten times greater than the value of input torque applied to drive shaft 160. This example assumes no frictional losses within tool 100. Accordingly, forces applied to tool 100 at drive shaft 160 to achieve a certain torque level will be significantly smaller than if forces are applied directly to first wrench 110 and second wrench 120 as in conventional wrenches. In some examples, worm ring 140 and worm screw 150 have a gear ratio between about five and fifty or, more specifically, between ten and thirty.

Referring generally to FIG. 1 and particularly to, e.g., FIGS. 2A-2C, second wrench 120 is fixed to worm ring 140. The preceding subject matter of this paragraph characterizes example 17 of the present disclosure, wherein example 17 also includes the subject matter according to any one of examples 1 to 16, above.

When second wrench 120 is fixed to worm ring 140, loads can be transferred between second wrench 120 and worm ring 140 during operation of tool 100. Second wrench 120 may engage second component 220 of assembly 200 and rotate second component 220 relative to first component 210. This may occur when worm ring 140 is rotated relative to ring support 130. It should be noted that ring support 130 fixedly supports first wrench 110 during operation of tool 100.

Referring generally to FIG. 1 and particularly to, e.g., FIGS. 3A and 3B, worm ring 140 comprises ring slot 142 and a portion of second wrench 120 is received within ring slot 142 of worm ring 140. The preceding subject matter of this paragraph characterizes example 18 of the present disclosure, wherein example 18 also includes the subject matter according to any one of examples 1 to 17, above.

Ring slot 142 provides circumferential support to second wrench 120 when the portion of second wrench 120 is received within ring slot 142. This feature allows transferring loads between second wrench 120 and worm ring 140 while maintaining the orientation of second wrench 120 relative to worm ring 140. Second wrench 120 may have a tight fit in ring slot 142 of worm ring 140. Furthermore, second wrench 120 may further coupled to worm ring 140 using a fastener such that second wrench 120 does not move relative to worm ring 140 along worm-ring rotation axis 101*b*.

Referring generally to FIG. 1 and particularly to, e.g., FIGS. 2A and 2B, second wrench 120 is an open-end wrench. The preceding subject matter of this paragraph characterizes example 19 of the present disclosure, wherein example 19 also includes the subject matter according to any one of examples 1 to 18, above.

The open end of second wrench 120 allows engaging second component 220 of assembly 200 with second wrench 120 by, for example, sliding second wrench 120 over second component 220. Second component 220 may be a nut (e.g., a hexagonal nut) or a shaft with two parallel engagement surfaces. Two inner surfaces of second wrench 120 may contact two corresponding surfaces of second component 220 when transferring loads between second wrench 120 and second component 220.

Referring generally to FIG. 1 and particularly to, e.g., FIGS. 2A-2C, second wrench 120 is box-end wrench. The preceding subject matter of this paragraph characterizes example 20 of the present disclosure, wherein example 20 also includes the subject matter according to any one of examples 1 to 18, above.

When second wrench 120 is a box-end wrench, second wrench 120 can contact with multiple flat surface portions and/or corners of second component 220 while when transferring loads between second wrench 120 and second component 220. As such, when second wrench 120 is a box-end wrench, higher loads may be transferred between second wrench 120 and second component 220 than, for example, an open-end wrench. Second component 220 may be a nut (e.g., a hexagonal nut). Second wrench 120 may engage or disengage second component 220 by translating along worm-ring rotation axis 101*b*.

Referring generally to FIG. 1 and particularly to, e.g., FIGS. 2B, 2F, 4A, 4D, and 4E, tool 100 further comprises first bearing 161 and second bearing 162, rotationally coupling worm screw 150 to ring support 130. The preceding subject matter of this paragraph characterizes example 21 of the present disclosure, wherein example 21 also includes the subject matter according to any one of examples 1 to 20, above.

First bearing 161 and second bearing 162 reduce friction losses when worm screw 150 rotates relative to ring support 130. First bearing 161 and second bearing 162 may be slip bearings, roll bearings, ball bearings, or other types of bearings. Worm screw 150 may be disposed between first bearing 161 and second bearing 162. Specifically, first bearing 161 and second bearing 162 may be used to maintain orientation of worm screw 140 relative to ring support 130. As such, first bearing 161 and second bearing 162, together with other components of tool 100, maintain engagement of worm screw 150 with worm ring 140 as, for example, schematically shown in FIG. 2B.

Referring generally to FIG. 1 and particularly to, e.g., FIGS. 2B, 2F, 4A, 4D, and 4E, tool 100 further comprises first bearing support 163 and second bearing support 164. First bearing support 163 and second bearing support 164 are fixed to ring support 130. First bearing support 163 retains first bearing 161. Second bearing support 164 retains second bearing 162. The preceding subject matter of this paragraph characterizes example 22 of the present disclosure, wherein example 22 also includes the subject matter according to example 21, above.

First bearing support 163 retains first bearing 161 in a fixed position relative to ring support 130. Similarly, second bearing support 164 retains second bearing 162 in a fixes position relative to ring support 130. Bearing supports 163 and 164 and bearings 161 and 162 together with ring support 130 also maintain position of worm screw 150 relative to worm ring 140. First bearing support 163 and second bearing support 164 may be removably attached to ring support 130. Alternatively, one or both of first bearing support 163 and second bearing support 164 may be monolithic with ring support 130. First bearing 161 may be pressed fit into first bearing support 163, while second bearing 162 may be pressed fit into second bearing support 164. As such, first bearing support 163 and second bearing support 164 retains respective bearings 161 and 162 and prevent bearings 161 and 162 from sliding relative to first bearing support 163 and second bearing support 164 along worm-screw rotation axis 101*a*.

Figure 2F:
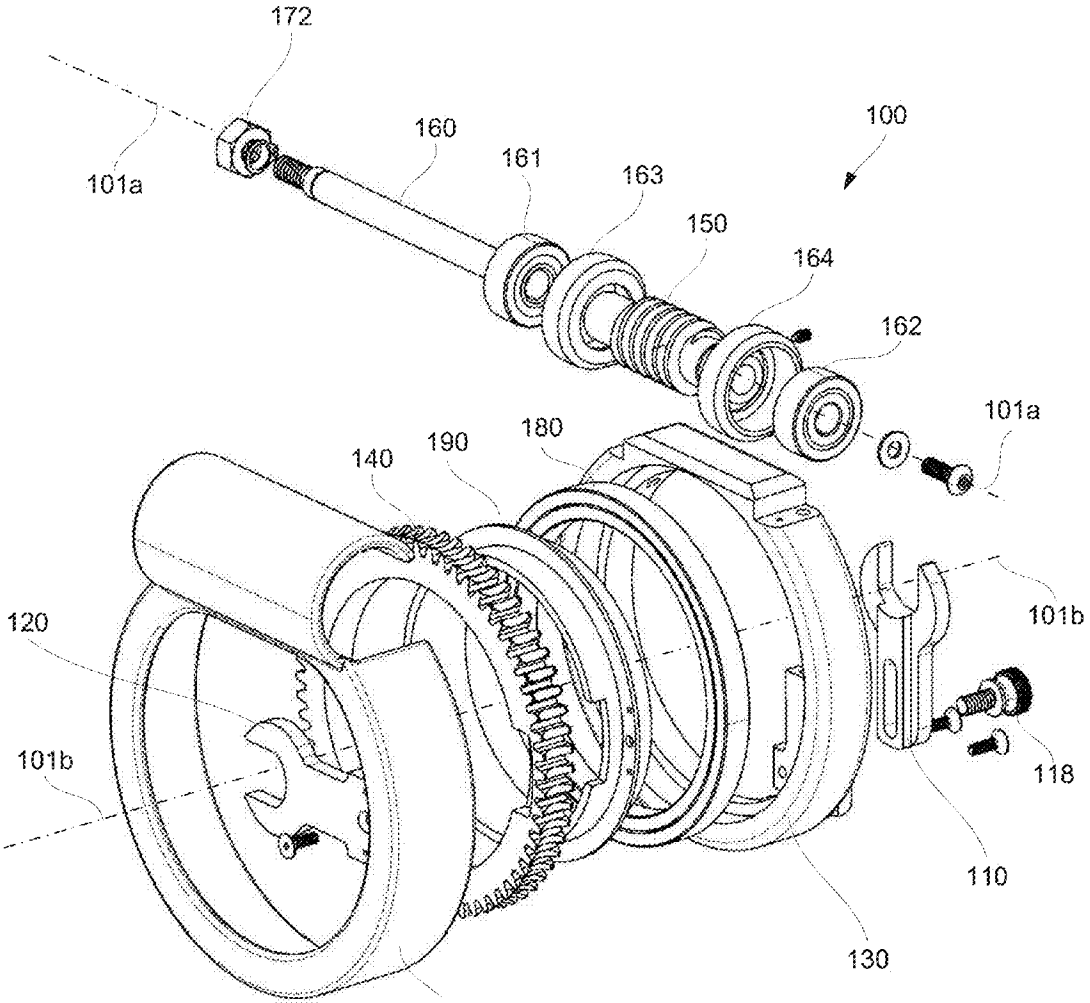

Referring generally to FIG. 1 and particularly to, e.g., FIGS. 2F and 4D, tool 100 further comprises drive shaft 160, rotationally supported by first bearing 161 and second bearing 162. Worm screw 150 is fixed to drive shaft 160. Worm screw 150 is between first bearing 161 and second bearing 162. The preceding subject matter of this paragraph characterizes example 23 of the present disclosure, wherein example 23 also includes the subject matter according to any one of examples 21 to 22, above.

Drive shaft 160 is fixed to worm screw 150 such that drive shaft 160 and worm screw 150 rotate together. Any torque applied to drive shaft 160 is transferred to worm screw 150 and vice versa. Drive shaft 160 may be monolithic with worm screw 150. For examples, the threads of worm screw 150 may formed while fabricating drive shaft 160. Alternatively, screw 150 may be fixed to drive shaft in such a way that drive shaft 160 does not rotate relative to worm screw 150. For example, a key-slot combination may be used for fixing drive shaft 160 to work screw 150.

Worm screw 150 may be positioned between first bearing 161 and second bearing 162 to maintain engagement of worm screw 150 relative to worm ring 140. Drive shaft 160 may extend outside of the space between first bearing 161 and second bearing 162 to provide access to drive shaft 160 during operation of tool 100. For example, a torque may be applied to the extending end of drive shaft 160 to rotate worm screw 150 and, as a result, other components of tool 100.

Referring generally to FIG. 1 and particularly to, e.g., FIGS. 2A, 2C, 2D, 2E, and 2F, tool 100 further comprises drive nut 172, fixed to drive shaft 160. The preceding subject matter of this paragraph characterizes example 24 of the present disclosure, wherein example 24 also includes the subject matter according to example 23, above.

Drive nut 172, fixed to drive shaft 160, is used to apply torque to drive shaft 160. The torque may be applied using a tool that engages drive nut 172 and rotate drive nut 172. For example, an external wrench may be used to rotate to drive nut 172, which causes rotation of drive shaft 160 and other components of tool 100.

Referring generally to FIG. 1 and particularly to, e.g., FIGS. 2F and 4A, worm screw 150 is hollow and drive shaft 160 passes through worm screw 150. The preceding subject matter of this paragraph characterizes example 25 of the present disclosure, wherein example 25 also includes the subject matter according to any one of examples 23 to 24, above.

Drive shaft 160 passes through worm screw 150 and may be a continuous structure. Drive shaft 160 may continuously extend, at least, between first bearing 161 and second bearing 162 and, in some examples, outside the space between first bearing 161 and second bearing 162. The continuity of drive shaft 160 ensures rigidity of drive shaft 160 and helps with maintaining the orientation of worm screw 150 (supported by drive shaft 160) relative to worm ring 140. For example, drive shaft 160 may be a round cylinder with worm screw 150 slid over drive shaft 160. Drive shaft 160 is not rotationally fixed relative worm screw 150 around worm-screw rotation axis 101*a*. For example, a slot-key combination may be used to ensure this non-rotatable engagement.

Referring generally to FIG. 1 and particularly to, e.g., FIG. 2B, tool 100 further comprises dual-direction torque limiter 170, coupled to worm screw 150. The preceding subject matter of this paragraph characterizes example 26 of the present disclosure, wherein example 26 also includes the subject matter according to any one of examples 1 to 23 and 25, above.

Dual-direction torque limiter 170 is used to prevent excessive torque from being applied to worm screw 150. This torque limitation also limits radial forces applied on tool 100 and assembly 200 during operation of tool 100. Dual-direction torque limiter 170 may limit the torque by slipping or uncouple the load entirely. For example, dual-direction torque limiter 170 may be a friction plate slip-clutch. Alternatively, dual-direction torque limiter 170 may include a shear pin.

Referring generally to FIG. 1 and particularly to, e.g., FIG. 2A, tool 100 further comprises housing 102, enclosing at least worm screw 150. The preceding subject matter of this paragraph characterizes example 27 of the present disclosure, wherein example 27 also includes the subject matter according to any one of examples 1 to 26, above.

Housing 102 may be used to shield moving components of tool 100 and specifically interfaces between moving components to prevent external objects from interfering with operation of tool 100. For example, an interface between worm ring 140 and worm screw 150 may be protected by housing 102. Another interface that may be protected by housing 102 is an interface between worm ring 140 and support ring 130. Housing 102 also allows to maintain lubrication in these moving interfaces.

Examples of the present disclosure may be described in the context of aircraft manufacturing and service method 1100 as shown in FIG. 5 and aircraft 1102 as shown in FIG. 6. During pre-production, illustrative method 1100 may include specification and design (block 1104) of aircraft 1102 and material procurement (block 1106). During production, component and subassembly manufacturing (block 1108) and system integration (block 1110) of aircraft 1102 may take place. Thereafter, aircraft 1102 may go through certification and delivery (block 1112) to be placed in service (block 1114). While in service, aircraft 1102 may be scheduled for routine maintenance and service (block 1116). Routine maintenance and service may include modification, reconfiguration, refurbishment, etc. of one or more systems of aircraft 1102.

Each of the processes of illustrative method 1100 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 5, aircraft 1102 produced by illustrative method 1100 may include airframe 1118 with a plurality of high-level systems 1120 and interior 1122. Examples of high-level systems 1120 include one or more of propulsion system 1124, electrical system 1126, hydraulic system 1128, and environmental system 1130. Any number of other systems may be included. Although an aerospace example is shown, the principles disclosed herein may be applied to other industries, such as the automotive industry. Accordingly, in addition to aircraft 1102, the principles disclosed herein may apply to other vehicles, e.g., land vehicles, marine vehicles, space vehicles, etc.

Apparatus(es) and method(s) shown or described herein may be employed during any one or more of the stages of the manufacturing and service method 1100. For example, components or subassemblies corresponding to component and subassembly manufacturing (block 1108) may be fabricated or manufactured in a manner similar to components or subassemblies produced while aircraft 1102 is in service (block 1114). Also, one or more examples of the apparatus(es), method(s), or combination thereof may be utilized during production stages 1108 and 1110, for example, by substantially expediting assembly of or reducing the cost of aircraft 1102. Similarly, one or more examples of the apparatus or method realizations, or a combination thereof, may be utilized, for example and without limitation, while aircraft 1102 is in service (block 1114) and/or during maintenance and service (block 1116).

Different examples of the apparatus(es) and method(s) disclosed herein include a variety of components, features, and functionalities. It should be understood that the various examples of the apparatus(es) and method(s) disclosed herein may include any of the components, features, and functionalities of any of the other examples of the apparatus(es) and method(s) disclosed herein in any combination, and all of such possibilities are intended to be within the scope of the present disclosure.

Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples illustrated and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims. Accordingly, parenthetical reference numerals in the appended claims are presented for illustrative purposes only and are not intended to limit the scope of the claimed subject matter to the specific examples provided in the present disclosure.

What is claimed is:

1. A tool for rotating a first component of an assembly relative to a second component of the assembly, the tool comprising:

a ring support, comprising a ring slot;

a first wrench, translatably coupled to the ring support;

a worm ring, rotationally coupled to the ring support;

a second wrench, coupled to the worm ring;

a worm screw, rotationally coupled to the ring support and in mesh with the worm ring; and a wrench base, wherein:

at least a portion of the wrench base is received within the ring slot of the ring support, and the wrench base is fixed to the ring support.

2. The tool according to claim 1, wherein:

the worm ring has a worm-ring rotation axis;

the first wrench has an elongated opening and a translation axis, perpendicular to the worm-ring rotation axis and parallel to the elongated opening; and the first wrench is translatable relative to the ring support along the translation axis, which intersects the worm-ring rotation axis.

3. The tool according to claim 2, further comprising a fastener, extending through the elongated opening of the first wrench and coupling the first wrench to the ring support.

4. The tool according to claim 3, wherein, when the first wrench is not locked relative to the ring support by the fastener, the first wrench is translatable a finite distance relative the ring support along the translation axis.

5. The tool according to claim3, wherein the fastener is operable to lock the first wrench relative to the ring support.

6. The tool according to claim 5, wherein the first wrench is lockable relative to the ring support in a fixed position.

7. The tool according to claim,5 wherein the first wrench is lockable relative to the ring support in any one of a plurality of fixed positions.

8. The tool according to claim 3, wherein the elongated opening is circumferentially closed.

9. The too according to claim 2, wherein the worm screw is rotatable about a worm-screw rotational axis, which is perpendicular to the worm-ring rotational axis.

10. The tool according to claim 1, wherein:

the wrench base comprises a base slot, and a portion of the first wrench is translatably received within the base slot of the wrench base.

11. The tool according to claim 1, further comprising a bearing, rotationally coupling the worm ring to the ring support.

12. The tool according to claim 11, further comprising a coupler, wherein:

the worm ring is fixed to the coupler, and the bearing rotationally couples the coupler to the ring support.

13. The tool according to claim 1, wherein the second wrench is fixed to the worm ring.

14. The tool according to claim 1, further comprising a first bearing and a second bearing, rotationally coupling the worm screw to the ring support.

15. The tool according to claim 14, further comprising a first bearing support and a second bearing support, wherein:

the first bearing support and the second bearing support are fixed to the ring support, the first bearing support retains the first bearing, and the second bearing support retains the second bearing.

16. The tool according to claim 14, further comprising a drive shaft, rotationally supported by the first bearing and the second bearing, wherein:

the worm screw is fixed to the drive shaft, and the worm screw is between the first bearing and the second bearing.

17. The tool according to claim 16, further comprising a drive nut, fixed to the drive shaft.

18. The tool according to claim 16, wherein:

the worm screw is hollow, and the drive shaft passes through the worm screw.

19. The tool according to claim 1, further comprising a dual-direction torque limiter , coupled to the worm screw.

20. The tool according to claim 1, further comprising a housing, enclosing at least worm screw.

* * * * *